US011638450B2

(12) United States Patent
Jackson

(10) Patent No.: US 11,638,450 B2
(45) Date of Patent: May 2, 2023

(54) SAFETY GLOVE SYSTEM

(71) Applicant: Michael Jackson, Oakland, CA (US)

(72) Inventor: Michael Jackson, Oakland, CA (US)

( * ) Notice: Subject to any disclaimer, the term of this patent is extended or adjusted under 35 U.S.C. 154(b) by 141 days.

(21) Appl. No.: 17/101,405

(22) Filed: Nov. 23, 2020

(65) Prior Publication Data

US 2021/0401095 A1 Dec. 30, 2021

Related U.S. Application Data

(60) Provisional application No. 63/045,332, filed on Jun. 29, 2020.

(51) Int. Cl.
*A41D 19/00* (2006.01)
*A41F 1/06* (2006.01)

(52) U.S. Cl.
CPC ..... *A41D 19/0062* (2013.01); *A41D 19/0006* (2013.01); *A41D 19/0058* (2013.01); *A41D 19/0075* (2013.01); *A41F 1/06* (2013.01)

(58) Field of Classification Search
CPC ..... A41D 19/0006; A41D 19/01; A41D 19/0044; A41D 19/0055; A41D 19/0058; A41D 19/0062; A41D 19/0068; A41D 19/0075; A61F 1/06
See application file for complete search history.

(56) References Cited

U.S. PATENT DOCUMENTS

| | | | | |
|---|---|---|---|---|
| 4,696,065 | A * | 9/1987 | Elenteny | A61B 42/00 2/164 |
| 5,483,697 | A * | 1/1996 | Fuchs | A61B 42/10 2/21 |
| 5,896,983 | A * | 4/1999 | Wood | A61B 42/40 206/278 |
| 6,973,675 | B2 * | 12/2005 | Cheng | A41D 19/0058 2/161.7 |
| D654,635 | S * | 2/2012 | Reaux | D29/117.1 |
| 9,241,518 | B2 * | 1/2016 | Patkov | A41D 19/01547 |
| 10,786,021 | B2 * | 9/2020 | Harrison | A41D 19/0068 |
| 11,129,425 | B1 * | 9/2021 | Sulaiman | A41D 19/0006 |
| 2012/0311767 | A1 * | 12/2012 | Mizrahi | A41D 19/0072 2/158 |
| 2021/0330002 | A1 * | 10/2021 | Cohen-Sahalon | A41D 19/0006 |
| 2021/0345716 | A1 * | 11/2021 | Bedrosian | A41D 19/0058 |

* cited by examiner

*Primary Examiner* — F Griffin Hall
(74) *Attorney, Agent, or Firm* — Brennan, Manna & Diamond, LLC

(57) ABSTRACT

The present invention relates to a disposable safety glove system featuring a plurality of layers of inter-nested gloves that are worn simultaneously by a user. The improved disposable glove system of the present invention allows a user to peel away the outermost layer of gloves to reveal a new and sterile set of gloves. The glove system also features a relatively thick wristband to support the plurality of glove layers, a tab that can be used to easily peel off the outermost glove layer once the same has been used and a new pair of gloves is desired, and a numbering system that alerts the user to how many glove layers remain in the glove stack.

4 Claims, 3 Drawing Sheets

SAFETY GLOVE SYSTEM

CROSS-REFERENCE TO RELATED APPLICATION

The present application claims priority to, and the benefit of, U.S. Provisional Application No. 63/045,332, which was filed on Jun. 29, 2020 and is incorporated herein by reference in its entirety.

BACKGROUND

The present invention relates generally to the field of hand gloves. More specifically, the present invention relates to a disposable glove system featuring several layers of individual gloves attached to a common wristband, wherein each individual glove layer can be peeled off in succession after each individual use. The system further comprises a pull tab that can be used by the user to easily peel off the outermost layer of glove to reveal the next successive layer of glove. The multi-layered glove system of the present invention reduces the spread of germs, bacteria, viruses, and other pathogens, as well as reducing the likelihood of cross-contamination by always ensuring that a clean or sterile pair of gloves are available to the user. Accordingly, the present disclosure makes specific reference thereto. However, it is to be appreciated that aspects of the present invention are also equally amenable to other like applications, devices and methods of manufacture.

By way of background, many surfaces are repeatedly touched each day by a large number of individuals, thereby presenting a pathway for the rapid transmission of germs, bacteria, viruses, pathogens and the like from one to many individuals in a relatively short period of time. More specifically, surfaces, such as doors, door handles, ATM key pads, transaction pads for retailers, elevator buttons, phones, money, and other objects are used frequently by people, and are prone to contamination. Further, in hospitals and other health care centers, germs can be easily transmitted from patients to doctors and other health care workers, and vice versa, thereby spreading diseases amongst those seeking treatment and that may already have a decreased ability to fight off infection.

Most individuals take precautions in their day to day lives to avoid coming into contact with such germs, bacteria, viruses, pathogens and the like. For example, to prevent the spread of such undesirable organisms, individuals oftentimes use a disinfectant spray or wipe on exposed surfaces, such as those found on tables, doors, door handles, elevator buttons, key pads and other frequently touched surfaces, to kill any germs, bacteria, viruses, pathogens and the like. Generally, the wipes are impregnated with a disinfectant composition containing microbe killing ingredients. However, many people would prefer not to use such products in public or to have to constantly carry such items around to perform the cleaning. Further, electronic equipment, such as sensitive touch screens or keypads, may be damaged when disinfectants are applied thereto. Additionally, disinfecting solutions applied to such surfaces do not always ensure that the entire surface will be cleaned and sanitized, or that they will remain clean and sanitized. For example, the individual performing the cleaning could easily miss a spot, or the cloths or wipes being used may have been previously contaminated from another surface. Consequently, the process of having to continuously disinfect each and every space that a user may come into contact throughout the day is both tiring and time consuming.

Other solutions, such as fumigation or spraying, are widely used for disinfection of an entire area in order to sanitize the area without much effort and time. For example, a healthcare worker may carry a fumigation machine around, which is used to spread various chemicals to kill harmful viruses and bacteria in the surroundings. However, the process of fumigating a room of enclosed space typically requires that the space be empty, and remain empty for some period of time. Furthermore, the fumigation method typically involves the use of harmful and toxic chemicals which, if inhaled even in small amounts, can cause serious illness or death to those exposed thereto. Such solutions are particularly dangerous for individuals already suffering from respiratory disorders and breathing problems.

Washing hands frequently also helps in the prevention of the spread of germs, bacteria and virus, both during pandemics and in places of easy disease transmission. However, people may be unable to constantly wash their hands due to lack of accessibility to water, soap or the like. In such scenarios, hand sanitizers may be used, and can also be used after washing the hands to ensure that the hands are germ free. Hand sanitizers are gels that contain alcohol in order to kill the germs present on the skin. The alcohol present in the sanitizer solution works immediately and effectively in order to kill bacteria and most viruses. However, people often forget to carry hand sanitizer while travelling, and therefore are not always able to use the product to clean their hands, for example before or after touching an infected or germ prone surface. Further, it becomes difficult for people to use hand sanitizers after each and every contact with the contaminated surfaces as the prolonged, regular and continued use of hand sanitizers can cause skin irritation, dryness or other skin conditions. Therefore, the solution of hand sanitizing fails even if the user fails to sanitize their hands just once.

Additionally, during a pandemic or other outbreak of disease, in order to prevent the spread of germs and other harmful microorganisms, people often wear disposable gloves on their hands to curb the spread of germs, bacteria, and viruses. Most standard disposable gloves are worn and must be thrown away after each use, as the glove itself could become contaminated and become a mode of transmission. For example, latex gloves, such as those commonly used by healthcare workers, are usually discarded after performing a single duty of function, such as a surgery, changing a dressing, bathing, suctioning, cleaning body waste products, exposure to patients with infectious diseases or the like. However, healthcare workers may forget to put on a new or sterile glove before each task, or put on such a glove and then touch a contaminated surface before performing the required task. Further, the user's hand may become contaminated in the process of removing an unclean glove and then contaminate the surface of the clean glove while putting the same onto the user's hand, thereby defeating the entire process of changing gloves. Also, in many medical procedures, several pairs of gloves may be required for each patient and users become reluctant to spend the considerable amount of time required to pull on and take off multiple pairs of gloves in a relatively short time frame.

Therefore, there exists a long felt need in the art for a device that can be used to prevent the transmission of germs and diseases from one person to another. There is also a long felt need in the art for a glove system that enables a user to travel safely without worrying about the spread of diseases during, for example, a time of pandemic. Additionally, there is a long felt need in the art for a glove system that provides a supply of clean gloves on demand, and that that can be easily changed as needed with minimal effort and/or risk of cross-contamination. There is also a long felt need in the art for a disposable glove system that reduces the amount of time it takes to change gloves, and that is convenient to use and store. Finally, there is a long felt need in the art for a disposable glove system that is inexpensive to manufacture, and safe and easy to use.

The subject matter disclosed and claimed herein, in one embodiment thereof, comprises a disposable glove system featuring a plurality of layers of overlapping gloves that are worn by a user simultaneously. More specifically, the improved disposable glove system of the present invention allows a user to peel away the outermost glove layer after the same has been exposed to contamination to reveal a new, underlying and sterile glove. The glove system of the present invention features a single wristband to support the plurality of glove layers, and a pull tab that can be used to easily peel off the outermost glove layer after the same has been used and without contaminating the underling or next successive glove layer. The present invention offers a more convenient disposable glove that keeps the wearer safe from germs, bacteria, viruses, pathogens, and the like.

In this manner, the improved disposable glove system of the present invention accomplishes all of the forgoing objectives, and provides a user with a ready supply of sterile disposable gloves. The disposable glove system of the present invention is convenient, enables a user to quickly don a clean pair of gloves with minimal effort, and is easily stored and/or transported in a pocket or purse of the user. Finally, the disposable glove system of the present invention keeps the wearer safe from germs, bacteria, viruses, dirt, contamination and other pathogens.

SUMMARY

The following presents a simplified summary in order to provide a basic understanding of some aspects of the disclosed innovation. This summary is not an extensive overview, and it is not intended to identify key or critical elements or to delineate the scope thereof. Its sole purpose is to present some concepts in a simplified form as a prelude to the more detailed description that is presented later.

The subject matter disclosed and claimed herein, in one embodiment thereof, comprises a disposable glove system featuring a plurality of glove layers that are worn simultaneously. More specifically, the disposable glove system of the present invention allows a user to quickly and effortlessly peel away the outermost layer of the gloves to reveal a new set of gloves immediately beneath the glove set to be disposed of. The gloves feature a sturdy wristband that is removably attached to each of the plurality of glove layers. Further, the glove system comprises a plastic tab that can be used to easily peel off the top layer of the gloves. The disposable gloves of the system of the present invention can be of any size and color as per the preferences of the user.

In an alternative embodiment, the subject matter disclosed and claimed herein comprises a glove system comprised of a plurality of peel away personal safety gloves. The peel away safety glove system features several layers of gloves that are worn simultaneously by a user. The outermost glove layer is used while performing any activity until such time as it becomes soiled or contaminated. At such time, the user utilizes a tab structure located on the wristband of the system to peel off and properly dispose of the used layer so as to avoid contamination of the next successive glove layer. In this manner, the user can easily acquire a new set of gloves for each use, and can dispose of the used gloves without any difficulties. The innovative disposable glove design reduces the expense, effort and time of the user in having to change gloves. Each successive pair of gloves is readily available to the user after every use, and can be conveniently worn by the users.

In a further embodiment of the present invention, a peel away safety glove system is disclosed. The peel away safety gloves can be constructed using latex, plastic, PET or other suitable materials, such as nitrile and vinyl. The gloves can be manufactured using any elastic or flexible material, and the exact size, measurement, construction, and design may vary to suit user need and/or preference. Each glove of the peel away safety glove system may include a number or a symbol denoting the count of the glove and/or indicating the count of the remaining gloves available to the user in the system. The peel away safety gloves can be worn on either or both of the user's right and left hands. In accordance with the preferred form of the invention, the peel away safety gloves may further comprise an orientation of a neutral glove, in that the same glove shape can be worn on either hand, thereby increasing functionality and reducing inventory requirements.

In yet another embodiment of the present invention, the peel off safety gloves are comprised of a relatively thin elastomeric and anti-microbial material, such as a plastic, latex rubber or the like, and has a wall thickness of less than 0.009 inches. In an alternate embodiment, the wall thickness of each of the plurality of gloves can be in a range between 0.005-0.02 inches. Nonetheless, the wall thickness and size of the gloves is not limited and can be manipulated as per the preferences of the user. The peel off safety glove system may be made in packages of 7 to 15 glove layers, for example, when more layers are needed for frequent glove changes, or may be made in packages of 3 to 6 layers, for example, when less glove layers are needed for a particular task or a more convenient carrying size is preferred. However, the number of glove layers in a particular system is not limited to the forgoing, and can be selected as per the preferences of the users or the requirements of the job being performed.

The subject matter disclosed and claimed herein, in another embodiment thereof, includes a method for wearing the glove system of the present invention on a human hand. The method comprises the steps of initially inserting a hand inside the innermost glove layer of the glove system such that each of the fingers and thumb are inserted into corresponding portions of the glove. Next, the outermost glove layer is utilized to perform a particular task or activity. A plastic tab disposed on the wrist portion of the outermost glove may then be pulled to remove the outermost glove layer from the glove set. As the outermost glove layer is removed from the system, the next successive and sterile glove layer is exposed and ready for subsequent use or activity.

In a still further embodiment of the presently described invention, a glove stack is presented and includes a plurality of gloves contained within a stack, with the stack having an outermost glove layer and a series of inner glove layers nested within the outermost glove. Each of the plurality of glove layers has finger portions and a base portion, wherein each of the inner glove layers fits within the finger portion and is coterminous with the base portion of the outermost glove layer. Further, a wristband portion is disposed at the base of each of the glove layers, with the wristband portion having a thickness greater than a thickness of the glove stack. A tear tab is disposed on each of the glove layers in the glove stack, wherein the tear tab disposed along the base of each of the glove layers and adjacent to the wristband.

In a further embodiment of the presently described invention, a method of using a stack of personal protective equipment is closed and comprises the steps of initially providing a stack of gloves with the stack having an outer glove layer and a series of inner glove layers nested within the outer glove layer. Each of the series of glove layers has finger portions and a base portion, and each of the inner glove layers fits within the finger portion and coterminous with the base portion of the outer glove layer. The stack further having a wristband portion disposed at the base of each of the glove layers, and having a thickness greater than a thickness of the stack. A tear tab is disposed on each of the gloves in the glove stack, with the tear tab disposed along the base of each of the glove layers and adjacent the wristband. Next, a hand is inserted into an innermost glove of the stack, and the tear tab on the outermost glove is grasped and used to remove the outermost glove and exposed the next successive glove in the stack.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
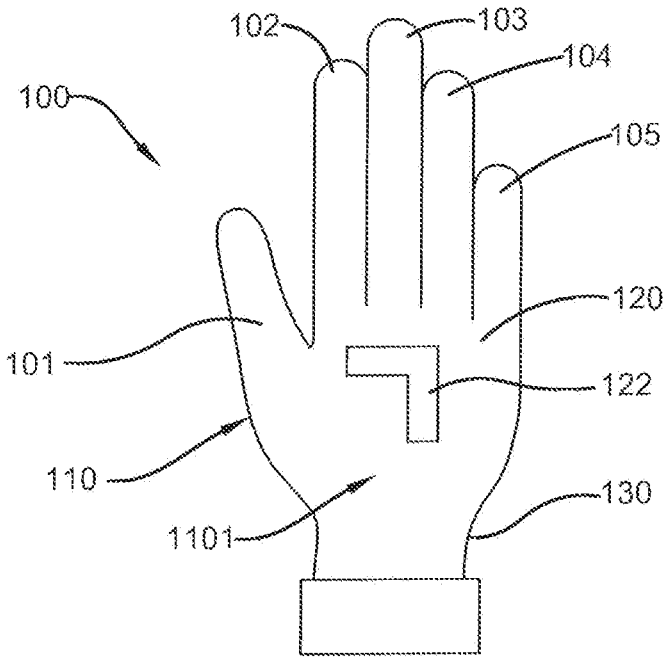
FIG. 1 illustrates a front perspective view of one possible embodiment of a peel away safety glove system of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention or do not limit the scope of the invention. Additionally, an illustrated embodiment need not have all the aspects or advantages shown. Thus, in other embodiments, any of the features described herein from different embodiments may be combined.

As noted above, there exists a long felt need in the art for a glove system that can be used to prevent the transmission of germs and diseases from one person to another by ensuring that a user has a ready supply of disposable and sterile gloves. Additionally, there is a long felt need in the art for a glove system that enables a user to change disposable gloves without exposing their hands to the ambient air or other potentially contaminated surfaces, with minimal effort and/or risk of cross-contamination between the used and replacement gloves. There is also a long felt need in the art for a disposable glove system that reduces the amount of time it takes to change gloves, and that is convenient to use and store.

The innovative product of the present invention features a disposable glove system having several layers of nested gloves that are worn simultaneously by the user. More specifically, the glove system provides a series of individual gloves that come in a stack of nested gloves with separate gloves being inserted inside of one another and the outermost glove layer. In use, the improved disposable glove system of the present invention allows a user to peel away each separate glove layer beginning with the outermost layer of used gloves to reveal a new and sterile set of gloves immediately beneath the outermost glove layer. The glove system includes a relatively thick wristband to support the various glove layers, which may be easily separable therefrom along a cut or perforated line. Further, each glove layer in the glove stack includes a plastic tab that can be used to easily peel off the outermost glove layer to reveal the next underlying glove layer when, for example, the outermost glove layer becomes contaminated. The glove system of the present invention offers a more convenient disposable glove for users that keeps the wearer safe from germs, bacteria, viruses, and other pathogens. The disposable glove system of the present invention can be of any size and color as per the preferences of the user or the requirements of the particular activity being performed.

In a further embodiment of the present invention, a peel away safety glove system is disclosed and comprises a plurality of inter-nested glove layers. Each of the glove layers is preferably comprised of a latex or other suitable material, such as nitrile or vinyl, that exhibits elastic or flexible properties. Each of the various glove layers of the peel away safety glove system may further comprise a number or a symbol denoting the count of the current glove layer, and/or indicating the remaining number of glove layers that are available to the user before the glove stack is exhausted. The peel away safety gloves can be worn on either of the user's hands, and can be designed to be worn on a single hand only.

Referring initially to the drawings, FIG. 1 illustrates a front perspective view of one possible embodiment of a peel away safety glove system 100 of the present invention in accordance with the disclosed architecture. Teach of the gloves in the peel off safety glove system 100 is preferably an orientation neutral glove, meaning that the same glove shape may be used to receive either a left or a right hand. In an alternative embodiment, separate gloves can be manufactured for each of the wearer's left and right hands, particularly when a more form fitting arrangement is required, for example, for precision work.

Each of the gloves in the system 100 has a typical five finger neutral configuration with finger portions 102, 103, 104, 105, and a thumb portion 101 of different length to approximate the size and configuration of a human hand. The gloves can of course be made in different sizes, if desired, such as for adults, children, men and/or women. The glove system 100 comprises multiple layers of gloves, with an outermost layer 110 ready for use for performing any activity or service and multiple layers of inner glove layers nested therein (see e.g., FIG. 5) for subsequent use.

Each of the glove layers has a front side 1101 having a palm portion 120 and a wrist area 130. The palm portion 120 and/or the wrist area may include designs, patterns, textures or the like to enhance the aesthetic appearance or functionality of each the gloves in the system 100. The palm portion 120 of the glove 100 may further comprise a symbol 122 denoting, for example, the hand for which the glove 100 is intended, or may include any other logo 123, personalized designs, user name, or the like, as per the preferences of the user.

The glove system 100 is further comprised of a relatively thick or sturdy wristband at the wrist area 130 to support the multiple glove layers. The wristband provides strength to the multi-layer structure of the peel away safety gloves system 100 (e.g., as an outermost layer is being peeled away), and provides a hassle-free mechanism for changing or removing the various outermost glove layers 110 as needed. Accordingly, the precise or appropriate thickness of the wristband portion will vary upon the number of glove layers that are in the gloves system 100, wherein each of the glove layers is approximately between 5-20 mils in thickness, depending upon the particular application.

In addition to accommodating the thickness of the glove stack, the bulk of thickness of the wristband also provides support for the user's wrist, and to withstand the tearing pressures from removing each glove from the stack after use. More specifically, the wristband preferably has a thickness ranging from about 30 mils to about 350 mils. The thickness is calculated so that the peel strength of removing the outermost glove layer from the stack is between 0.1 N/mm to 1.5 N/mm, and so that the wristband will not tear when subjected to such peeling pressures.

Multiple inner layers of gloves are sleeved over one another, and an outermost glove layer 110 completely covers the inner glove layers (see e.g., FIG. 5), such that the appearance of the glove 100 gives a look of a single glove worn by the user. Each of the safety gloves are preferably comprised of an anti-microbial material or coating on a very thin elastomeric material such as latex rubber or the like. Other suitable materials, such as nitrile, vinyl, and the like, that provides protection against bacteria, viruses and other harmful microorganisms can be used for manufacturing the peel off safety gloves. The gloves are preferably of substantially equal size when placed in the stack, and are not substantially displaced or splayed out of alignment when in the stack so that they are coterminous with the wristband section of the glove stack 100.

The peel away safety gloves can also be long enough to cover a wrist area of the user, though the length of the gloves is not so restricted and may cover the hands and forearms of the user to the elbow or only the hands, as per the needs and requirements of the user. Each glove layer of the glove system 100 preferably has a wall thickness of less than 0.009 inches (9 mils). In an alternate embodiment, the wall thickness of each layer of the gloves can be in a range between 0.005-0.02 inches (5 mils to 20 mils). Nonetheless, the wall thickness and size of the gloves are not limited, and the wall thickness of each of the glove layers may be selected in a manner such that the multiple layers are comfortable to wear and convenient to use. Further, the peel off safety gloves may be manufactured in packages of 7 to 15 layers when more layers are needed for frequent glove changes, or may be made in layer packages of 3 to 6 layers when less layers are needed. However, the number of layers of gloves in a peel away safety glove 100 is not limited and can be selected as per the preferences of the users. In a further embodiment of the present invention, each layer of the glove 100 may also be impregnated, for example, with a scent and/or possibly with an antibacterial agent to protect the transmission of germs and microbes such as bacteria and viruses to users.

Figure 2:
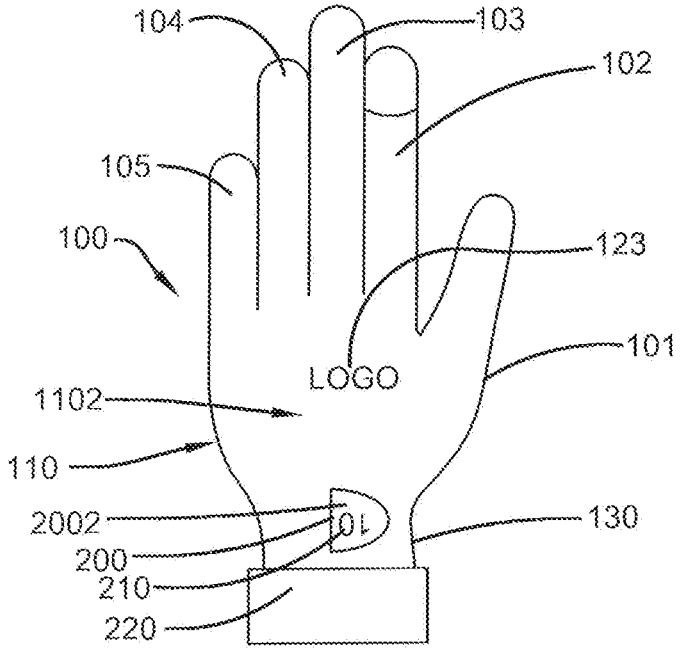
FIG. 2 illustrates a rear perspective view of one possible embodiment of a peel away safety glove system of the present invention in accordance with the disclosed architecture.

FIG. 2 illustrates a rear perspective view of one possible embodiment of a peel away safety glove system 100 of the present invention in accordance with the disclosed architecture. More specifically, the safety glove system 100 is comprised of a rear side 1102 having a plastic tab 200 which serves as a pulling mechanism for peeling off the outermost glove layer 110, and revealing an inner glove layer (not shown) for use. The tab 200 is preferably a generally U-shaped or C-shaped cut out portion at a wrist area 130, which can be held by a user and pulled out conveniently. As best shown in FIG. 2, a relative thick wristband 220 is also provided at the wrist area 130 of the glove system 100 for supporting multiple layers of gloves. The wristband 220 provides strength to the glove system 100 structure, particularly when the outermost glow layer is being peeled away by a user to expose the next successive glove layer.

In a preferred embodiment of the present invention, an upper surface 2002 of the plastic tab 200 includes a symbol 210 denoting the count of the glove layer 110, and/or indicating the count of remaining gloves inside the glove system 100. The symbol 210 may be a number or letter and may be provided in an increasing or advancing or decreasing or declining manner. For example, the plastic tab 200 depicted in FIG. 2 denotes the number "10", which indicates that the outermost glove layer 110 is the tenth layer of the disposable safety glove system 100 and, when the outermost glove layer 110 is removed by the user, nine inner glove layers of the disposable safety glove system 100 remain available for use. In another embodiment of the present invention, the numbering of glove layers can be provided on the front surface 1101 and/or back surface 1102. Further, the back portion 1102 of the glove layer 110 may include, designs, personalized prints, the user's name or the like for aesthetic purposes.

In an alternate embodiment of the present invention, the plastic pull tab 200 can be positioned at any other location along the glove system 100, such as on the front surface or around wrist area 130. The style and position of the plastic tab 200 is not limited, and can be designed and placed as per the needs and desires of the user. The user can hold the plastic tab 200 and pull off the outermost glove layer 110 by pulling the tab 200 from the wrist area 130 in the general direction towards finger portions 102, 103, 104 and 105, thereby exposing the next successive and sterile glove layer. The pulling means 200 enables the user to change gloves easily and without much effort, and does not require the user to expose his or her hands to the environment.

Figure 3:
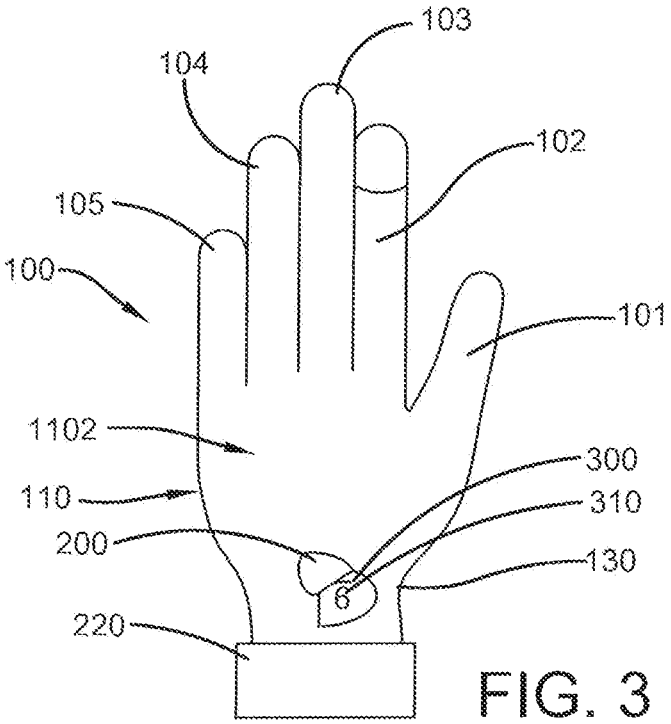
FIG. 3 illustrates a rear perspective view of one possible embodiment of a peel away safety glove system of the present invention in accordance with the disclosed architecture, wherein the peel away tab is partially lifted to expose the next successive glove layer.

FIG. 3 illustrates a rear perspective view of one possible embodiment of a peel away safety glove system 100 of the present invention in accordance with the disclosed architecture, wherein the peel away tab 200 is partially lifted to expose the next successive glove layer. More specifically, a pull tab 200 is present on the wrist area 130 of an outermost glove layer 110 of the multi-layer glove system 100, and may be used by the user to peel off the outermost glove layer 110 by stretching the plastic pull tab 200 from the wrist area 130 towards finger portions 102, 103, 104 and 105. Once the outermost glove layer 110 is completely stretched, the outer glove layer 110 is removed and inner layer 310 is revealed.

The plastic tab 200 on the outermost glove layer 110 completely or substantially overlaps a plastic tab 300 on an inner glove layer 310. Once the plastic tab 200 of outer glove layer 110 is torn and peeled away from the multi-layer glover structure 100, the plastic tab 300 of inner glove layer 310 is visible, indicating the count of the glove layer 310 and/or the count of the remaining inner glove layers as well. As previously stated, the relatively thick wristband 220 supports the peeling off of the various glove layers, and provides a convenient mechanism for changing gloves.

Figure 4:
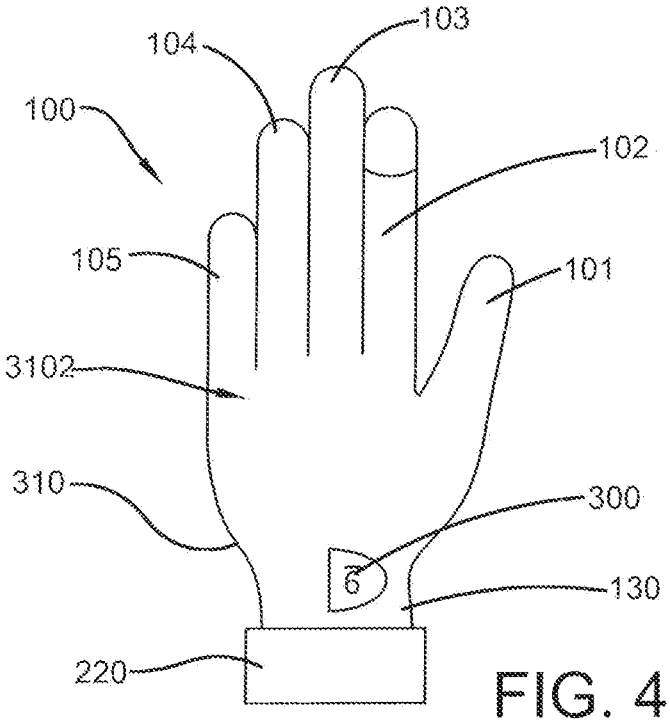
FIG. 4 illustrates a rear perspective view of one possible embodiment of the next successive glove layer of the peel away safety glove system of FIG. 3 in accordance with the disclosed architecture.

FIG. 4 illustrates a rear perspective view of one possible embodiment of the next successive glove layer of the peel away safety glove system 100 of FIG. 3 in accordance with the disclosed architecture. More specifically, as an outermost glove layer 110 is peeled off and properly disposed of, the next successive glove layer 310 is revealed for use. The inner glove layer 310 comprises a structure similar to the structure of the outermost glove layer 110, and includes a plastic tab 300 at a rear surface 3102 for pulling off the inner glove layer 310 once the same becomes soiled or contaminated. Each of the inner layers 310 include the plastic tab 300 which is a cut out portion on the glove surface that enables the easy removal of that particular glove layer at the appropriate time.

The multi-layer glove system 100 of the present invention may be manufactured in a plain white color, or in a variety of different colors, patterns, or decorative prints. The decorative prints could be available in various themes, such as hospital, water, animated themes, flowers, geometrical shapes, such as lines, crosses, rectangles, triangles or sinusoidal lines, sports, logos, designs or a combination of any of these patterns.

Figure 5:
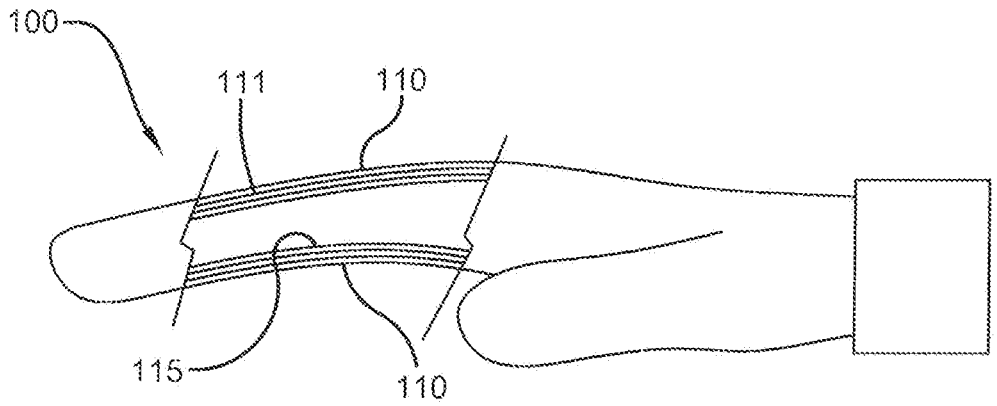
FIG. 5 illustrates a side cross sectional cut away view of the peel away safety glove system of the present invention in accordance with the disclosed architecture, wherein each of the various layers of the glove system of the present invention are depicted.

FIG. 5 illustrates a side cross sectional cut away view of the peel away safety glove system 100 of the present invention in accordance with the disclosed architecture, wherein each of the various layers of the glove system 100 of the present invention are depicted. More specifically, FIG. 5 illustrates the outermost glove layer 110, and then successive inner glove layers 111, 115, etc. Each of the inner glove layers are nested within the next successive outer glove layer such that the finger portions fit within the finger portion of the outer glove, and the base portions are all coterminous.

As previously stated, each of the peel away safety gloves of disposable safety glove system 100 is manufactured using latex or other suitable materials such as nitrile, vinyl, elastomeric materials or the like. The disposable safety gloves 100 of the present invention can be used by a user in everyday routines such as while travelling, cooking food, cleaning surfaces, or the like. Further, the disposable safety gloves 100 can also be used by healthcare workers for performing duties such as surgeries, changing a dressing, bathing a patient, suctioning a fluid, cleaning body waste or the like, each of which requires the user to frequently change his or her gloves to prevent the transmission of germs, diseases, bacteria and the like. As previously stated, each of the glove layers is preferably relative thin to provide sufficient tactile sensitivity and freedom of hand movement to the user in order to perform various different activities.

In an alternate embodiment, each outermost glove layer of the disposable safety glove 100 (e.g., as each successive layer is removed) is slightly larger than the next successive inner layer, such that the inner layer easily fits inside the outer layer. Further, the successive layers of the multi-layer disposable safety glove 100 may be removably connected at selected points, such as at the base of the palm portion of the glove, at the knuckles of the finger portions on the back side of the glove, on the wrist portion on both sides of the glove, or any other portions or edges. The bonding of the successive glove layers at only selected strategic points allows ease of hand flexing and movement, without the outer layer slipping relative to the inner layer. In this manner, the unique design of the gloves 100 greatly reduces the discomfort of wearing double gloves or the multi-layered gloves, as well as reducing hand fatigue of the wearer. The successive layers may be connected by use of heat treatment during manufacturing of the multi-layer peel away safety gloves, wherein the ends of the inner and outer layers extending beyond the wrist may be bonded and rolled together to form a convenient gripping means in the form of a relatively thick wristband, as previously described.

The multi-layer disposable safety glove system 100 is preferably manufactured by immersing a glove mold into a bath to be covered with a coating of latex, elastomeric substance or other suitable material. The mold is dried which forms an outer glove layer. Once the outer layer is formed, a slipping coating is applied to the outer glove layer and the mold is again dipped into the bath to form another glove layer. The mold is again dried to form an inner glove layer. The process of coating with slipping layer and with latex or other suitable material is then repeated to form the successive glove layers. After all layers are formed, the glove is removed from the mold and is turned inside out, such that the first layer formed on the mold becomes the outermost layer of the multi-layer glove structure. The method of manufacturing is not limited and other manufacturing methods can be employed to produce the peel away safety gloves of the present invention.

Certain terms are used throughout the following description and claim to refer to particular features or components. As one skilled in the art will appreciate, different persons may refer to the same feature or component by different names. This document does not intend to distinguish between components or features that differ in name but not structure or function. As used herein "peel away safety gloves", "peel off safety glove", "multi-layer safety glove", and "disposable safety glove" are interchangeable and refer to the peel away safety glove system 100 of the present invention. As used herein "plastic tab" refers to a cut-out portion on the surface of each glove layer for pulling out the used glove layer easily. As used herein "plastic tab", "plastic pull tab" and "pull tab" are used interchangeably to describe a pulling mechanism for each glove layer of the peel away safety glove system 100 of the present invention, and the same is not necessarily limited to plastic.

Notwithstanding the forgoing, the peel away safety glove system 100 of the present invention can be of any suitable size and configuration as is known in the art without affecting the overall concept of the invention, provided that it accomplishes the above stated objectives. One of ordinary skill in the art will appreciate that the size, configuration and material of the peel away safety glove system 100 as shown in the FIGS. are for illustrative purposes only, and that many other sizes of the peel away safety glove system 100 are well within the scope of the present disclosure. Although the dimensions of the peel away safety glove system 100 are important design parameters for user convenience, the peel away safety glove system 100 may be of any size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of using a stack of personal protective equipment comprising the steps of:

providing a stack of gloves comprising an outer glove and a plurality of inner gloves nested within the outer glove, each glove of the stack of gloves having finger portions and a base portion and each of the plurality of inner gloves fitting within the finger portions and the base portion of the outer glove, wherein the stack of gloves is further comprised of a (a) wristband portion disposed at the base portion of each of the gloves in the stack of gloves, the wristband portion having a thickness that is greater than a thickness of the stack of gloves, and (b) a tear tab disposed on each of the gloves in the stack of gloves, wherein the tear tab is disposed along the base portion of each of the gloves in the stack of gloves and adjacent the wristband portion;

inserting a hand into an innermost glove of the stack of gloves;

grasping the tear tab on the outer glove; and pulling the tear tab to unperforate the outer glove from the wristband portion and expose one of the plurality of inner gloves.

2. The method of using a stack of personal protective equipment of claim 1, wherein the step of pulling is accomplished using a force of less than 1.5 N/mm.

3. The method of using a stack of personal protective equipment of claim 1, wherein each of the gloves in the stack of gloves is comprised of one of a latex, a plastic, a PET, a nitrile or a vinyl, and further wherein and each of the gloves in the stack of gloves has a thickness of between 5 and 20 mils.

4. The method of using a stack of personal protective equipment of claim 1, wherein each tear tab is provided with a unique number or letter.

* * * * *